US005547262A

United States Patent [19]

Braun et al.

[11] Patent Number: 5,547,262

[45] Date of Patent: Aug. 20, 1996

[54] GUIDE RAIL FOR SCRAPER CONVEYOR OF MINING MACHINE

[75] Inventors: Ernst Braun; Gert Braun, both of Essen, Germany

[73] Assignee: DBT Deutsche Bergau-Technik GmbH, Wuppertal, Germany

[21] Appl. No.: 397,691

[22] Filed: Mar. 1, 1995

[30] Foreign Application Priority Data

Mar. 5, 1994 [DE] Germany ..... 9403731 U

[51] Int. Cl.[6] ..... E21C 29/02

[52] U.S. Cl. ..... 299/43; 105/29.1

[58] Field of Search ..... 299/34, 42, 43; 105/29.01

[56] References Cited

U.S. PATENT DOCUMENTS 4,813,748 3/1989 Waddington et al. ..... 299/43

5,161,858 11/1992 Braun et al. ..... 299/43

FOREIGN PATENT DOCUMENTS 2603986 8/1977 Germany .

*Primary Examiner*—David J. Bagnell

*Attorney, Agent, or Firm*—Herbert Dubno; Andrew Wilford

[57] ABSTRACT

A mining apparatus has a longitudinally extending conveyor, a guide-rail assembly secured to the conveyor and forming an upwardly open cruciform passage, a drive chain in the passage, and a mining machine displaceable along the assembly and having a toothed drive wheel engageable in the chain in the passage. The rail assembly is formed by a main rail fixed to the conveyor and forming a portion of the passage and a secondary rail fixed to the main rail and forming the rest of the passage. The secondary rail forms offset from the passage a horizontally outwardly open and longitudinally extending slot and the mining machine has a foot received in and longitudinally displaceable along the slot.

8 Claims, 3 Drawing Sheets

GUIDE RAIL FOR SCRAPER CONVEYOR OF MINING MACHINE

FIELD OF THE INVENTION

The present invention relates to a guide rail for a scraper conveyor of a mining machine. More particularly this invention concerns such a guide rail used on the conveyor of a long-wall coal plow.

BACKGROUND OF THE INVENTION

As described in German patent 2,603,986 filed Feb. 3, 1976, a machine of the type used for long-wall mining of coal has a conveyor to one side of which is secured a guide-rail assembly on which rides a mining machine that scrapes coal or ore from the face from which the coal or ore is being recovered. The guide-rail assembly forms an upwardly open cruciform-section passage in which is received a longitudinally displaceable round-link drive chain. The mining machine has a toothed wheel rotatable about a horizontal axis and positioned so its teeth can engage in the holes of the horizontal links of the chain, in effect using it like a rack.

The passage is formed by a plurality of metal bars that are bolted together to the conveyor so that the horizontal links are held relatively snugly, with limited ability to move relative to the rail assembly while the vertical links have substantial freedom of movement in the guide passage.

Such an assembly is subjected to enormous wear from the great forces being applied to it and the gritty and dirty environment is used in. In order to repair or work on the guide rail it is necessary to largely dismantle the conveyor. This is difficult and time-consuming, entailing substantial down time for the apparatus when it needs service.

SUMMARY OF THE INVENTION

The instant invention is an improvement on a mining apparatus having a longitudinally extending conveyor, a guide-rail assembly secured to the conveyor and forming an upwardly open cruciform passage, a drive chain in the passage, and a mining machine displaceable along the assembly and having a toothed drive wheel engageable in the chain in the passage. According to the invention the rail assembly is formed by a main rail fixed to the conveyor and forming a portion of the passage and a secondary rail fixed to the main rail and forming the rest of the passage. The secondary rail forms offset from the passage a horizontally outwardly open and longitudinally extending slot and the mining machine has a foot received in and longitudinally displaceable along the slot.

With this system, therefore, the chain can be exposed for repair simply by removing the secondary rail in the damaged region. The conveyor does not have to be touched and only the affected region need be worked on. Since the secondary rail also forms part of the guide slot for the mining machine, its removal also frees the mining machine for service. Furthermore this outer or secondary rail is normally the part subjected to the most wear and abuse, so that it can easily be replaced when it wears out. Fitting a new chain is similarly easy.

The passage has inner and outer horizontally confronting grooves and the chain has horizontal links slidable in the grooves. The outer groove has an upper and outer surface defined by the secondary rail and a lower surface defined by the main rail. Thus when the outer rail is removed the chain will remain in place, but can be lifted out. The main rail has an outwardly projecting ledge that defines a lower surface of the outer groove.

The secondary rail has a thickened bottom region that defines a narrow neck in the slot and the mining-machine foot has a thickened end that is trapped in the slot by the thickened bottom region of the secondary rail. Thus when the secondary rail is removed it also frees the mining machine.

In accordance with the invention the secondary rail is secured directly to the main rail by a plurality of bolts. Thus when the secondary rail is unbolted, the main rail is left in place.

The secondary rail can be formed by a plurality of secondary-rail sections each substantially shorter than the main rail. Alternately the main rail is formed by a plurality of main-rail sections each substantially shorter than the secondary rail.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
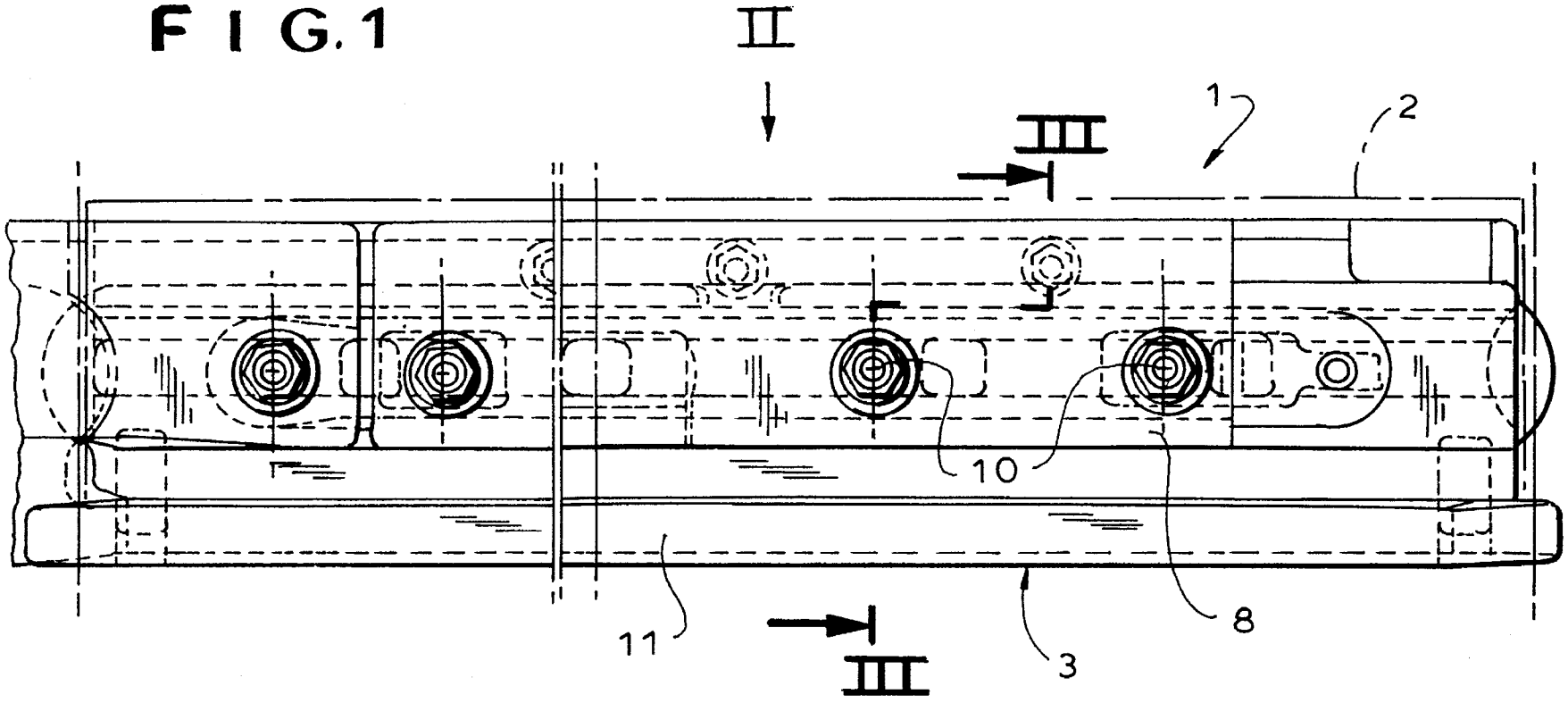
FIG. 1 is a small-scale side view of the guide rail and conveyor according to the invention.
Figure 2:
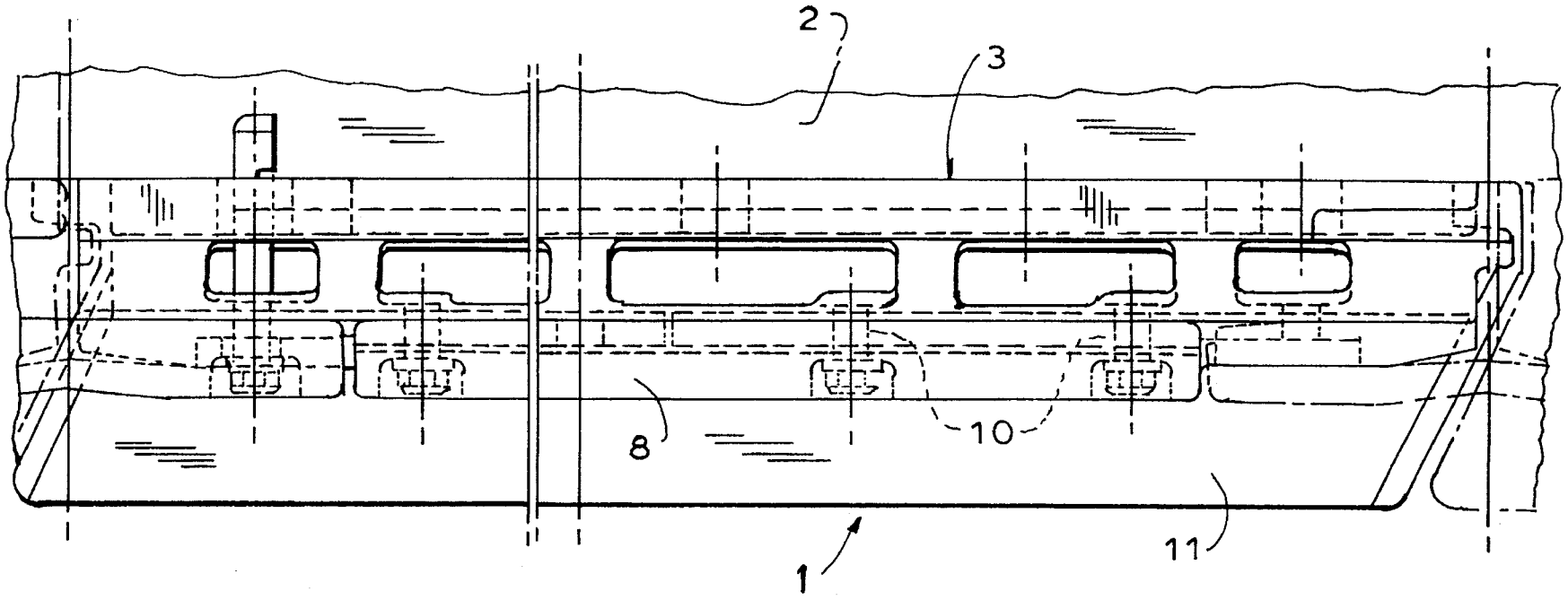
FIG. 2 is a top view taken in the direction of arrow II of FIG. 1.
Figure 3:
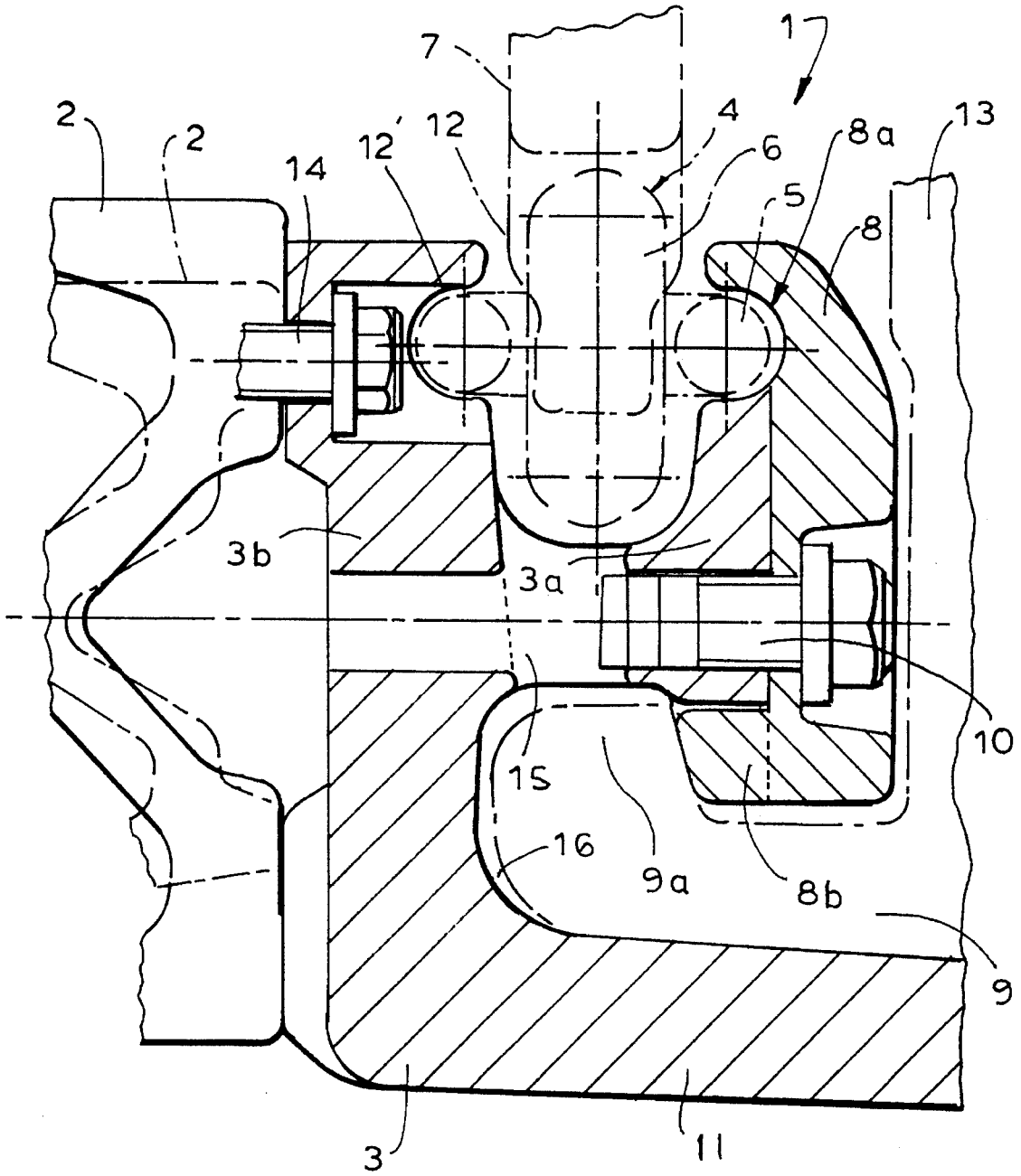
FIG. 3 is a cross section taken along line III—III of FIG. 1.

As seen in FIGS. 1 through 3 a guide-rail assembly 1 for a mining machine 13 is secured by bolts 14 to one side of a scraper-type conveyor 2. This rail assembly 1 is basically formed by a main rail 3 which is secured by the bolts 14 to the conveyor 2 and a secondary rail 8 which is secured by bolts 10 to the main rail 3. The lengths of the rails 3 and 8 can be identical or as shown the rails 8 can be shorter than the rails 3 so that each rail 3 carries several rails 8. Alternately the rails 8 can be much longer than the rails 3 so that the rails 8 serve as splice plates to join several such rails 3.

As best seen in FIG. 3, outer and inner portions **3*a* and 3*b* of the rail 3 and the rail 8 together form and upwardly open and longitudinally throughgoing cruciform passage 12 of uniform section. A round-link drive chain 4 having horizontal links 5 and vertical links 6 is longitudinally shiftable in the passage 12. The rails 3 and 8 together form a pair of confronting semicircular-section grooves 12*a* and 8*a* that snugly receive the horizontal links 5 of the chain 4, while the vertical links 4 are received with substantial play. The passage 12 is downwardly open at apertures 15** and is upwardly open along its entire length.

The mining machine 13 carries a large sprocket 7 which is rotatable about a horizontal axis and whose teeth engage down into the vertically throughgoing holes formed by the horizontal links 5 in the manner well known in the art, in effect making the chain 4 stabilized in the passage 12 act like a rack. In addition the rail 1 forms an L-section outwardly open slot 16 into which engages a foot 9 of the machine 13, with an enlarged outer end **9*a* of the foot 9 being trapped in this slot 16. The main rail or beam 3 has an outwardly projecting foot 11 that defines the lower side of the slot 16**.

The outer or secondary rail 8 forms the outside and upper surface of the outer groove 8*a* so that, when this rail 8 is removed, the chain 4 can be taken out of the passage. In addition this rail 8 has a thick foot 8*b* that serves to capture the enlarged outer end 9*a* of the foot 9 to lock same in the groove 16. Therefore removal of the rail 8 also allows the machine 13 to be freed from the rail assembly 1. The part 8 can be an intentionally sacrificial wear part that can be replaced when worn out.

We claim:

1. In a mining apparatus having a longitudinally extending conveyor;

a guide-rail assembly secured to the conveyor and forming an upwardly open cruciform passage extending a full length of the assembly;

a drive chain in the passage; and a mining machine displaceable along the assembly and having a toothed drive wheel engageable in the chain in the passage;

the improvement wherein the rail assembly is formed by a main rail fixed to the conveyor and forming a portion of the passage, a secondary rail on the main rail and forming the rest of the passage, and attachment means releasably securing the secondary rail to the main rail;

the main and secondary rails form offset from the passage a horizontally outwardly open and longitudinally extending slot having an inner flank formed by the main rail and an outer confronting flank formed by the secondary rail; and the mining machine has a foot received in and longitudinally displaceable along the slot and captured between the inner and outer flanks of the slot.

2. The improved mining apparatus defined in claim 1 wherein the passage has inner and outer horizontally confronting grooves and the chain has horizontal links slidable in the grooves, the outer groove having an upper and outer surface defined by the secondary rail.

3. The improved mining apparatus defined in claim 2 wherein the main rail has an outwardly projecting ledge that defines a lower surface of the outer groove.

4. The improved mining apparatus defined in claim 1 wherein the secondary rail has a thickened bottom region that defines the outer slot flank and the mining-machine foot has a thickened end that is trapped in the slot by the thickened bottom region of the secondary rail.

5. The improved mining apparatus defined in claim 1 wherein the attachment means is a plurality of bolts.

6. The improved mining apparatus defined in claim 1 wherein the secondary rail is formed by a plurality of secondary-rail sections each substantially shorter than the main rail.

7. The improved mining apparatus defined in claim 1 wherein the main rail is formed by a plurality of main-rail sections each substantially shorter than the secondary rail.

8. In a mining apparatus having a longitudinally extending conveyor;

a guide-rail assembly secured to the conveyor and forming an upwardly open cruciform passage extending a full length of the assembly;

a drive chain in the passage; and a mining machine displaceable along the assembly and having a toothed drive wheel engageable in the chain in the passage;

the improvement wherein the rail assembly is formed by a main rail fixed to the conveyor and forming a portion of the passage, a secondary rail fixed to the main rail and forming the rest of the passage, and bolts extending through and bearing on the secondary rail and seated in the main rail;

the main and secondary rails form offset from the passage a horizontally outwardly open and longitudinally extending slot having an inner flank formed by the main rail and an outer confronting flank formed by the secondary rail; and the mining machine has a foot received in and longitudinally displaceable along the slot and captured between the inner and outer flanks of the slot.

* * * * *